US010964259B1

(12) United States Patent
Chang

(10) Patent No.: US 10,964,259 B1
(45) Date of Patent: Mar. 30, 2021

(54) AMOLED DISPLAY DRIVING DEVICE WITH SWITCHING FRAME RATE

(71) Applicant: FocalTech Systems Co., Ltd., Hsinchu (TW)

(72) Inventor: Wen-Chih Chang, Hsinchu (TW)

(73) Assignee: FOCALTECH SYSTEMS CO., LTD., Hsinchu (TW)

( * ) Notice: Subject to any disclaimer, the term of this patent is extended or adjusted under 35 U.S.C. 154(b) by 0 days.

(21) Appl. No.: 16/943,309

(22) Filed: Jul. 30, 2020

(30) Foreign Application Priority Data

Apr. 17, 2020 (TW) ..... 109112951

(51) Int. Cl.
*G09G 3/3225* (2016.01)

(52) U.S. Cl.
CPC ..... *G09G 3/3225* (2013.01); *G09G 2310/061* (2013.01); *G09G 2320/0673* (2013.01)

(58) Field of Classification Search
CPC ..... G09G 2340/0435; G09G 2320/10; G09G 3/3208
See application file for complete search history.

(56) References Cited

U.S. PATENT DOCUMENTS

2019/0035337 A1* 1/2019 Kato ..... G09G 3/3266
2020/0192500 A1* 6/2020 Tripathi ..... G09G 3/20

FOREIGN PATENT DOCUMENTS

CN 109785782 A 5/2019
WO 2019091190 A 5/2019

* cited by examiner

*Primary Examiner* — Gerald Johnson
(74) *Attorney, Agent, or Firm* — Muncy, Geissler, Olds & Lowe, P.C.

(57) ABSTRACT

An AMOLED display driving device is switchable among plural frame rates, and includes a timing control unit, a panel driving unit, and an emission duty ratio control unit. Based on an input frame rate, the timing control unit changes the display time and V-blanking time in the frame period corresponding to the frame rate by extending V-blanking time, so that the display time in the frame period corresponding to the frame rate is equal to a standard display time. Based on the input frame data and frame timing, the panel driving unit drives an AMOLED display panel to display the input frame on the AMOLED display panel according to the changed display time and V-blanking time in the frame period corresponding to the frame rate. During the frame period corresponding to the frame rate, the emission duty ratio control unit applies plural emission pulses to the AMOLED display panel.

10 Claims, 3 Drawing Sheets

| Frame rate | Number of emission pulses | Emission frequency |
|---|---|---|
| 120Hz | 4 | 480Hz |
| 96Hz | 5 | 480Hz |
| 80Hz | 6 | 480Hz |
| 68.6Hz | 7 | 480.2Hz |
| 60Hz | 8 | 480Hz |

AMOLED DISPLAY DRIVING DEVICE WITH SWITCHING FRAME RATE

CROSS REFERENCE TO RELATED APPLICATION

This application claims the benefits of the Taiwan Patent Application Serial Number 109112951, filed on Apr. 17, 2020, the subject matter of which is incorporated herein by reference.

BACKGROUND

1. Field of the Disclosure

The present disclosure relates to an AMOLED display driving device with switching frame rate and, more particularly, to an AMOLED display driving device with switching frame rate, which is capable of keeping the display brightness of the AMOLED unchanged.

2. Description of Related Art

Due to the fast response characteristics of the Active Matrix Organic Light Emitting Diode (AMOLED) panel, the dynamic display effect can be greatly improved, but the power saving requirement during static display has to be addressed, resulting in that the switching of the frame rate is necessary. Therefore, in the design of the AMOLED display driving device, consideration should be given to avoiding the display variation caused by the switching of the frame rate during the switching process, and reducing the complexity of circuit design and the difficulty in use.

With the design of the conventional AMOLED display driving device, to achieve switching among different frame rates, different panel driving timings are generally used to drive the AMOLED display panel, which may cause different panel charging time and result in change of the display brightness of the panel. Moreover, because of the need to use a plurality of different panel drive timings, the AMOLED display driving device requires a larger memory to store a plurality of different settings, and has to retain sufficient conversion time in timing control, resulting in that the design of the driving circuit becomes difficult. In addition, for the change of the display brightness caused by different panel charging time, it not only needs to be compensated with other functions (such as Gamma) to reduce the change, but also affects other characteristics of the AMOLED display panel (such as Mura).

Therefore, it is desirable to provide an improved AMOLED display driving device to mitigate and/or obviate the aforementioned problems.

SUMMARY

An object of the present disclosure is to provide an AMOLED display driving device with switching frame rate, which is capable of keeping the display brightness of the AMOLED unchanged by controlling the display driving time unchanged and controlling the emission duty ratio of the entire frame unchanged when switching the frame rate.

To achieve the object, the present disclosure provides an AMOLED display driving device, which is switchable among a plurality of frame rates for display driving, each frame rate corresponding to a frame period, each frame period having a display time and a vertical blanking time, a display time in the frame period corresponding to a highest frame rate in the plurality of frame rates being a standard display time. The AMOLED display driving device includes: a timing control unit, which extends the vertical blanking time based on an input frame rate, to change the display time and the vertical blanking time in the frame period corresponding to the frame rate, so that the display time in the frame period corresponding to the frame rate is equal to the standard display time; a panel driving unit, which drives an AMOLED display panel based on input frame data and frame timing according to the display time and the vertical blanking time in the frame period corresponding to the frame rate changed by the timing control unit, so as to display the input frame data on the AMOLED display panel; and an emission duty ratio control unit, which applies a plurality of emission pulses to the AMOLED display panel during the frame period corresponding to the frame rate.

Other objects, advantages, and novel features of the disclosure will become more apparent from the following detailed description when taken in conjunction with the accompanying drawings.

DETAILED DESCRIPTION

The following embodiments describe the implementation and operation principles of the AMOLED display driving device with switching frame rate disclosed in the present disclosure. Those skilled in the art to which the present disclosure pertains may understand the features and effects of this disclosure through the above-mentioned embodiments, and may perform combination, modification, replacement or adaption based on the spirit of the present disclosure.

Figure 1:
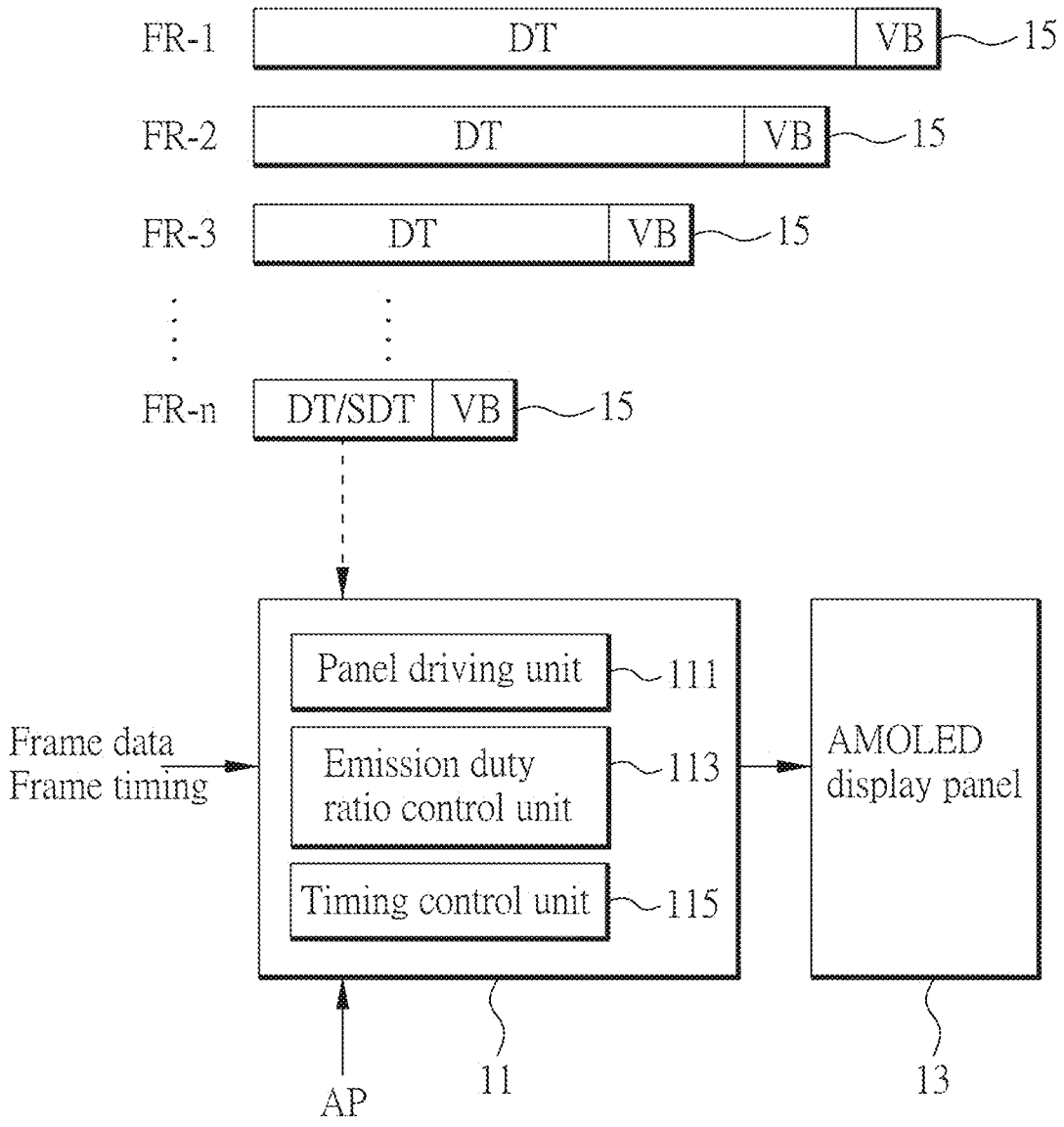
FIG. 1 shows a schematic diagram of driving an AMOLED display panel for display according to an embodiment of the present disclosure.

FIG. 1 shows a schematic diagram of an active matrix organic light emitting diode (AMOLED) display panel 13 driven by an AMOLED display driving device 11 for display according to an embodiment of the present disclosure. The AMOLED display driving device 11 includes a panel driving unit 111, an emission duty ratio control unit 113, and a timing control unit 115, which may drive the AMOLED display panel 13 according to the input frame data and frame timing so as to display the input frame data on the AMOLED display panel 13. In addition, the AMOLED display driving device 11 may also be configured by an external control such as an application processor (AP).

The aforementioned AMOLED display driving device 11 may be switched among a plurality of frame rates FR-i (i=1~n, n is an integer greater than 1) for display driving, wherein, the frame rate information for display driving is included in the input frame timing, or may be configured by the application processor (AP). Furthermore, as shown in FIG. 1, the frame rates FR-1, FR-2, FR-3, . . . FR-n increase sequentially; that is, the frame rate FR-n is the highest frame rate in the plurality of frame rates. Each frame rate FR-i corresponds to a frame period 15, and each frame period 15 has a display time (DT) and a vertical blanking time (VB), wherein the display time (DT) in the frame period 15 corresponding to the highest frame rate FR-n is defined as a standard display time (SDT).

Since the AMOLED display driving device 11 is switched or shifted among the plurality of frame rates FR-1, FR-2, FR-3, . . . FR-n for display driving, in order to achieve the purpose of changing the frame rate but keeping the brightness of the panel unchanged, the timing control unit 115 changes the display time (DT) and the vertical blanking time (VB) in the frame period 15 corresponding to the frame rate FR-i by extending the vertical blanking time (VB), so that the display time (DT) in the frame period 15 corresponding to the frame rate FR-i is equal to the standard display time (SDT).

Figure 2:
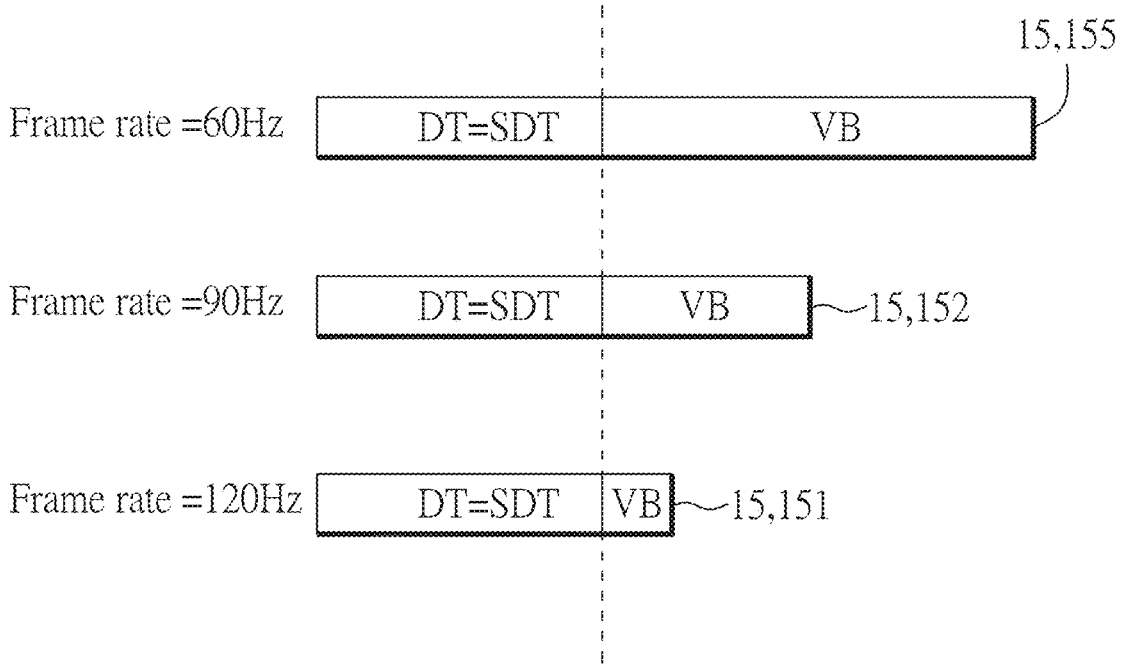
FIG. 2 shows a control example of the timing control unit of the AMOLED display driving device of the present disclosure.

Please refer to FIG. 2, it shows a control example of the timing control unit 115, which is illustrated by taking a plurality of frame rates including 60 Hz, 90 Hz and 120 Hz as an example, in which 120 Hz is the highest frame rate. As shown, the display time (DT) in the frame period 151 corresponding to the frame rate of 120 Hz is the standard display time (SDT), and the frame period 151 corresponding to the frame rate of 120 Hz minus the standard display time (SDT) is the vertical blanking time (VB) of the frame period 151. For the frame rate of 90 Hz, the display time (DT) in the corresponding frame period 152 is changed to be equal to the standard display time (SDT), and the vertical blanking time (VB) is extended to be equal to the frame period 152 corresponding to the frame rate of 90 Hz minus the standard display time (SDT). Similarly, for the frame rate of 60 Hz, the display time (DT) in the corresponding frame period 155 is changed to be equal to the standard display time (SDT), and the vertical blanking time (VB) is extended to be equal to the frame period 155 corresponding to the frame rate of 60 Hz minus the standard display time (SDT).

With the display time (DT=SDT) and the vertical blanking time (VB) in the frame period 15 corresponding to the frame rate FR-i that are changed by the timing control unit 115, based on the input frame data and frame timing, the panel driving unit 111 drives the AMOLED display panel 13 according to the frame period 15 corresponding to the frame rate FR-i changed by the timing control unit 115, so as to display the input frame data on the AMOLED display panel 13.

Furthermore, in order to achieve the purpose of changing the frame rate but keeping the brightness of the panel unchanged, during the frame period 15 corresponding to the frame rate FR-i, the emission duty ratio control unit 113 applies a plurality of emission pulses to the AMOLED display panel 13. The number of emission pulses applied is given such that the emission duty ratio of the frame period 15 corresponding to the frame rate FR-i is a fixed preset value; that is, for all frame rates FR-i, the corresponding emission duty ratio remains unchanged.

Figure 3:
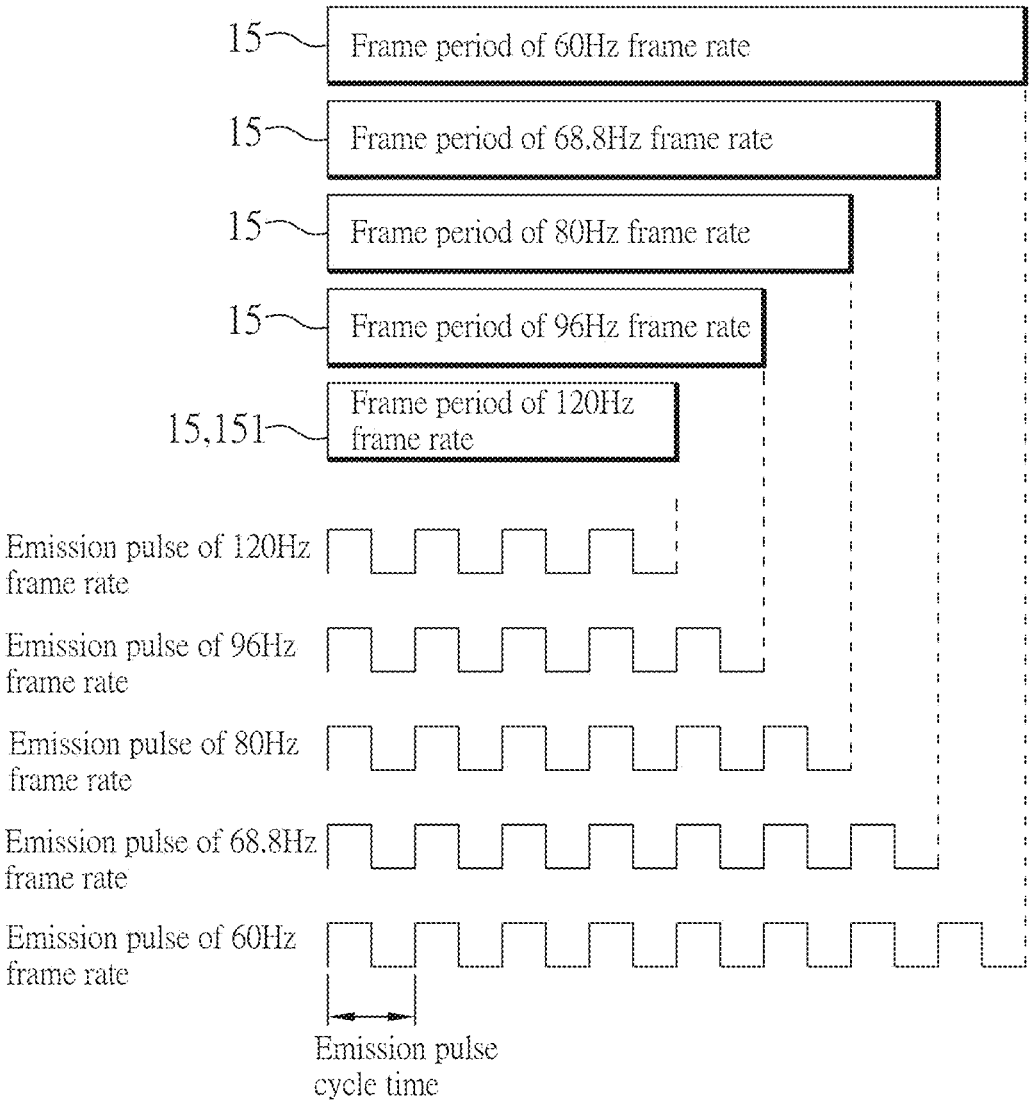
FIG. 3 shows a control example of the emission duty ratio control unit of the AMOLED display driving device of the present disclosure.

FIG. 3 shows a control example of the emission duty ratio control unit 113 of the present disclosure, which is illustrated by taking a plurality of frame rates including 60 Hz, 68.6 Hz, 80 Hz, 96 Hz and 120 Hz as an example, in which 120 Hz is the highest frame rate. As shown in FIG. 3, when switching to the highest frame rate of 120 Hz for display driving, the number of emission pulses applied by the emission duty ratio control unit 113 in the corresponding frame period 151 is equal to N, where N is an integer greater than 1. In this example, N is equal to 4; that is, in the corresponding frame period 151, the emission duty ratio control unit 113 applies 4 emission pulses.

In order to keep the emission duty ratio of the frame period 15 corresponding to the frame rate FR-i unchanged, when switching to a specific frame rate FR-j (j=1~n−1) (in this example, 60 Hz, 68.6 Hz, 80 Hz, or 96 Hz) other than the highest frame rate FR-n (in this example, 120 Hz) for display driving, the number of emission pulses applied by the emission duty ratio control unit 113 is equal to M, wherein M is determined by dividing the frame period 15 corresponding to the specific frame rate FR-j by a basic emission pulse cycle time. The basic emission pulse cycle time is equal to the frame period 151 corresponding to the highest frame rate FR-n divided by N. In this example, the basic emission pulse cycle time is $\frac{1}{120}$ seconds÷4=$\frac{1}{480}$ seconds and thus, when using the frame rate of 96 Hz for display driving, the number of emission pulses applied by the emission duty ratio control unit 113 is M=$\frac{1}{96}$ seconds÷$\frac{1}{480}$ seconds=5; when using the frame rate of 80 Hz for display driving, the number of emission pulses applied by the emission duty ratio control unit 113 is M=$\frac{1}{80}$ seconds÷$\frac{1}{480}$ seconds=6; when using the frame rate of 68.6 Hz for display driving, the number of emission pulses applied by the emission duty ratio control unit 113 is M=1/68.6 seconds÷$\frac{1}{480}$ seconds=7; when using the frame rate of 60 Hz for display driving, the number of emission pulses applied by the emission duty ratio control unit 113 is M=$\frac{1}{60}$ seconds÷$\frac{1}{480}$ seconds=8. Similarly, in this way, it is able to calculate the number of emission pulses corresponding to a desired frame rate between any two frame rates.

Furthermore, an emission pulse cycle time corresponding to the specific frame rate FR-j is equal to the frame period 15 corresponding to the specific frame rate divided by M. In this example, the emission pulse cycle time corresponding to the frame rate of 96 Hz is $\frac{1}{96}$ seconds÷5=$\frac{1}{480}$ seconds; the emission pulse cycle time corresponding to the frame rate of 80 Hz is $\frac{1}{80}$ seconds÷6=$\frac{1}{480}$ seconds; the emission pulse cycle time corresponding to a frame rate of 68.6 Hz is 1/68.6 seconds÷7=1/480.2 seconds; the emission pulse cycle time corresponding to the frame rate of 60 Hz is $\frac{1}{60}$ seconds÷8=$\frac{1}{480}$ seconds. Similarly, in this way, it is able to calculate the emission pulse cycle time corresponding to a desired frame rate between any two frame rates. It is noted that the calculated emission pulse cycle time may be fine-tuned so that M emission pulses can be completely applied to the frame period 15 corresponding to the specific frame rate FR-j, and the emission duty ratio of the frame period 15 corresponding to the specific frame rate FR-j is maintained to be the fixed preset value.

In addition, each frame rate corresponds to an emission frequency, and the emission frequency is defined as the frame rate multiplied by the number of emission pulses. As shown in FIG. 3, the emission frequencies of the frame rates of 120 Hz, 96 Hz, 80 Hz, 68.6 Hz and 60 Hz are 480 Hz, 480 Hz, 480 Hz, 480.2 Hz and 480 Hz, respectively, which are approximately equal or have little variation. It is noted that, when, for example, a desired frame rate between any two of the above frame rates corresponds to a large variation in the emission frequency, the amount of variation in the emission frequency corresponding to the frame rate can be reduced by adjusting the emission pulse cycle time of the frame rate or increasing the number of emission pulses.

As can be seen from the above description, with the AMOLED display driving device of the present disclosure, by only controlling the display driving time to be unchanged and controlling the emission duty ratio of the entire frame to be unchanged, the AMOLED display driving device of the present disclosure is capable of switching or shifting the frame rate without changing or causing variation of brightness of the AMOLED display panel.

The aforementioned embodiments are examples only for convenience of description. The scope of the present disclosure is claimed hereinafter in the claims and is not limited to the embodiments.

What is claimed is:

1. An AMOLED display driving device switchable among a plurality of frame rates for display driving, each frame rate corresponding to a frame period, each frame period having a display time and a vertical blanking time, a display time in the frame period corresponding to a highest frame rate in the plurality of frame rates being a standard display time, the AMOLED display driving device comprising:

a timing control unit, which extends the vertical blanking time, based on an input frame rate, to change the display time and the vertical blanking time in the frame period corresponding to the frame rate, so that the display time in the frame period corresponding to the frame rate is equal to the standard display time;

a panel driving unit, which drives an AMOLED display panel, based on input frame data and frame timing, according to the display time and the vertical blanking time in the frame period corresponding to the frame rate changed by the timing control unit, so as to display the input frame data on the AMOLED display panel; and an emission duty ratio control unit, which applies a plurality of emission pulses to the AMOLED display panel during the frame period corresponding to the frame rate.

2. The AMOLED display driving device of claim 1, wherein a number of emission pulses applied by the emission duty ratio control unit is given such that the emission duty ratio of the frame period corresponding to the frame rate is a fixed preset value.

3. The AMOLED display driving device of claim 2, wherein the timing control unit extends the vertical blanking time to be equal to the frame period corresponding to the frame rate minus standard display time.

4. The AMOLED display driving device of claim 2, wherein the input frame rate is included in the input frame timing.

5. The AMOLED display driving device of claim 2, wherein the input frame rate is configured by an application processor (AP).

6. The AMOLED display driving device of claim 2, wherein, when switching to a highest frame rate for display driving, a number of emission pulses applied by the emission duty ratio control unit is equal to N, where N is an integer greater than 1.

7. The AMOLED display driving device of claim 6, wherein, when switching to a specific frame rate other than the highest frame rate for display driving, a number of emission pulses applied by the emission duty ratio control unit is equal to M, where M is determined by dividing the frame period corresponding to the specific frame rate by a basic emission pulse cycle time, and the basic emission pulse cycle time is equal to the frame period corresponding to the highest frame rate divided by N.

8. The AMOLED display driving device of claim 7, wherein an emission pulse cycle time corresponding to the specific frame rate is equal to the frame period corresponding to the specific frame rate divided by M, and the emission pulse cycle time is fine-tuned so that M emission pulses are completely applied to the frame period corresponding to the specific frame rate, and the emission duty ratio of the frame period corresponding to the specific frame rate is maintained to be the fixed preset value.

9. The AMOLED display driving device of claim 8, wherein each frame rate corresponds to an emission frequency defined as the frame rate multiplied by a number of emission pulses of the frame rate, and the emission frequencies corresponding to the plurality of frame rates are substantially the same.

10. The AMOLED display driving device of claim 9, wherein, when performing display driving with a frame rate, an amount of variation in the emission frequency corresponding to the frame rate is reduced by adjusting the emission pulse cycle time of the frame rate or increasing a number of emission pulses of the frame rate.

* * * * *